US007081816B2

(12) United States Patent
Schebel et al.

(10) Patent No.: US 7,081,816 B2
(45) **Date of Patent: *Jul. 25, 2006**

(54) COMPACT WIRELESS SENSOR

(75) Inventors: Dean David Schebel, Port Coquitlam (CA); Julian P. Carlson, Blaine, WA (US)

(73) Assignee: ION Digital LLP, Blaine, WA (US)

( * ) Notice: Subject to any disclaimer, the term of this patent is extended or adjusted under 35 U.S.C. 154(b) by 222 days.

This patent is subject to a terminal disclaimer.

(21) Appl. No.: 10/837,087

(22) Filed: Apr. 30, 2004

(65) Prior Publication Data

US 2005/0024207 A1 Feb. 3, 2005

Related U.S. Application Data

(60) Provisional application No. 60/476,198, filed on Jun. 6, 2003.

(51) Int. Cl.
*G08B 13/08* (2006.01)

(52) U.S. Cl. ..... 340/545.6; 340/511; 340/545.7; 200/61.93

(58) Field of Classification Search ..... 340/545.6
See application file for complete search history.

(56) References Cited

U.S. PATENT DOCUMENTS

| | | | | |
|---|---|---|---|---|
| 3,696,359 | A | 10/1972 | Ross et al. | |
| 4,209,777 | A | 6/1980 | Morrison | |
| 4,360,856 | A * | 11/1982 | Witthaus | 361/170 |
| 4,403,341 | A * | 9/1983 | Hata | 455/100 |
| 4,855,713 | A | 8/1989 | Brunius | |
| 4,864,636 | A | 9/1989 | Brunius | |
| 5,003,747 | A | 4/1991 | Morton | |
| 5,007,199 | A | 4/1991 | Dunagan et al. | |
| 5,164,705 | A | 11/1992 | Dunagan | |

(Continued)

FOREIGN PATENT DOCUMENTS

| | | |
|---|---|---|
| DE | 20017433 | 3/2001 |

(Continued)

OTHER PUBLICATIONS

Interactive Technologies, Inc., "Recessed Micro Door/Window Sensor," May 2000.

(Continued)

*Primary Examiner*—Thomas Mullen
*Assistant Examiner*—George Bugg
(74) *Attorney, Agent, or Firm*—Kathleen T. Petrich

(57) ABSTRACT

A compact size wireless sensor for sensing a change of state that includes a sensor switch, a microprocessor, a wireless transmitter, a timer (e.g., a low power clock circuit), an antenna, and a coin cell battery power source. The coin cell battery, which is positioned in a stacking arrangement with the microprocessor, switch, and transmitter, allows the sensor to be of a significantly reduced size. Moreover, to provide long life despite a small battery, the microprocessor is run in a standby mode in which the microprocessor draws little power unless it actually samples the state of the sensor switch during select intervals. Various electronic components individually, or in combination, assist in the sampling (monitoring mode) in such a way as to reduce current consumption from the power source. The compact size makes the sensor ideally applicable for wireless intrusion systems embedded within hollow frames of windows and doors. Not only are such wireless sensors concealed and not readily seen by intruders, but the size allows the sensors to be installed within conventional sized window and door frames without piercing outer walls of the frames (thus avoiding nullification of window and door manufacturers' warranties).

39 Claims, 11 Drawing Sheets

U.S. PATENT DOCUMENTS

| | | | | |
|---|---|---|---|---|
| 5,572,190 | A * | 11/1996 | Ross et al. | 340/541 |
| 5,712,621 | A | 1/1998 | Andersen | |
| 5,761,206 | A | 6/1998 | Kackman | |
| 5,805,063 | A | 9/1998 | Kackman | |
| 5,809,013 | A | 9/1998 | Kackman | |
| 5,854,994 | A * | 12/1998 | Canada et al. | 702/56 |
| 5,872,512 | A | 2/1999 | Kackman | |
| 5,942,981 | A | 8/1999 | Kackman | |
| 6,724,316 | B1 * | 4/2004 | Addy et al. | 340/686.1 |
| 6,737,969 | B1 * | 5/2004 | Carlson et al. | 340/547 |
| 6,844,814 | B1 * | 1/2005 | Chin et al. | 340/539.22 |
| 6,902,117 | B1 * | 6/2005 | Rosen | 236/51 |
| 2003/0107483 | A1 * | 6/2003 | Kano | 340/540 |
| 2004/0090326 | A1 * | 5/2004 | Chin et al. | 340/539.22 |

FOREIGN PATENT DOCUMENTS

| | | | |
|---|---|---|---|
| GB | 2250367 | A * | 6/1992 |
| GB | 2356077 | | 5/2001 |
| NL | 1000644 | | 12/1996 |

OTHER PUBLICATIONS

ADEMCO (Alarm Device Manufacturing Company, a division of Pittway Corporation, Syosset, NY), "Installation Instructions for Recessed Transmitter", Apr. 1998.

* cited by examiner

COMPACT WIRELESS SENSOR

RELATED APPLICATION

This application claims priority to U.S. Provisional Patent Application Ser. No. 60/476,198, filed Jun. 6, 2003, invented by Dean D. Schebel, and entitled "Wireless Security Sensors."

TECHNICAL FIELD

The present invention relates to compact wireless sensors, and, particularly, for wireless security sensors for insertion within window and door frames as a means for detecting intrusion.

BACKGROUND OF THE INVENTION

Sensors have been around for many years for detecting a change of state. Security sensors, which detect a change of state when a door or window has been opened during an unauthorized time, or in some other unauthorized conditions, have routinely been used as part of a security system. Traditionally, intrusion of a door or window has been sensed by a break in an electromagnetic circuit using a device, such as a reed switch installed in one portion of the window or door (the frame or closure between the frame) and a magnet installed in the other portion of the window or door.

Sensors can be either hard wired or wireless as part of the security system. Known wireless sensors, even those intended to be hidden to some degree, are quite large. For example, known wireless security sensors, such as the ITI Recessed Micro Door Window Sensor (model 60-741-95) [Interactive Technologies, Inc. of North Saint Paul, Minn.] or Ademco Recessed Transmitter (model no. 5818) [Alarm Device Manufacturing Company of Syosset, N.Y.] have overall lengths of 3.8 inches and 4⅞ inches, respectively.

The Applicant's co-pending U.S. patent application Ser. No. 09/994,048 ("'048"), filed Nov. 27, 2001, and entitled "Wireless Security Sensor System," discloses a concealed, wireless security sensor positioned within windows and doors. The '048 patent application discloses a wireless security sensor system that has a wireless security sensor (in preferred form, a reed switch and magnet assembly) inserted into a hollow interior forming part of a window or door frame and that the exposed face of the sensor or the magnet assembly is nearly flush with the inner core of the frame that defines the hollow opening. The other complementary component (the reed switch or magnet assembly) is inserted within a closure device (the window or the door) to which the closure device moves relative to the frame between the open and closed positions.

The complementary component also has a face that is nearly flush with the perimeter surface of the closure such that the two faces of the complementary components are facing each other when the closure is in the closed position relative to the frame. When the face of the component containing the sensor is in the closed position and aligned with the face of the component containing the magnet assembly, the reed switch of the sensor closes in the presence of the magnetic field between the sensor and the magnetic assembly. A microprocessor monitors the state of the reed switch. When the closure is in the open position, the magnetic field is removed, and the reed switch opens, which in turn sends a signal to a wireless transmitter. The wireless transmitter may, in turn, transmit a signal to a receiving panel capable of emitting an audible alarm signal and/or a signal to security or police to indicate that the window/door has been opened.

The '048 patent application discloses that good placement of a wireless security sensor is within the inner and outer walls (or skins) of the window frame with a front face of the sensor housing positioned nearly flush with the inner wall of the window (or door) frame. In doing so, the sensor is hidden within the frame and is not readily seen to an intruder. Additionally, a wire antenna can be positioned within the hollow portion between the window or door frame so as to take up less space and be less conspicuous.

The afore-mentioned '048 patent application security system is useful for installation at the time of manufacturing where the size of the window may be made to accommodate the size of the wireless sensor. However, standard manufactured windows have a frame width between the interior and exterior wall or skins that are approximately ½ to 1 inch thick. Conventional wireless sensors, with lengths of 4–5 inches, can pierce the exterior skin of the frame when the face of the sensor is positioned nearly flush with the interior skin. And piercing the outer skin after the window/door leaves the manufacturer's shop may void window/door manufacturers' warranties by breaking the water seal provided by the manufacturers. Voiding a manufacturer's warranty is highly undesirable for security device manufacturers and installers. Such risk reduces the likelihood of obtaining after-market, concealed, wireless security systems.

Furthermore, size of the conventional wireless sensors is highly contingent on the sensor's power source. In the afore-mentioned ITI and Ademco wireless sensors, long life, high capacity, lithium batteries, namely, 3V lithium 123A batteries, such as Panasonic CR 123A or Duracell DL 123A models, are used as the power source. These lithium batteries have sufficient capacity to provide a long life, e.g., greater than 5 years, but are relatively large. These type batteries typically measure 60 mm long, (slightly under 2½ inches). In conjunction with the battery, the sensor switch and electronic components all add up to a sensor length of approximately 4 to 5 inches. If a smaller sized battery is used to create a smaller sensor, compensatory measures will need to be added if battery life span is not to be sacrificed.

SUMMARY OF THE INVENTION

The present invention is directed to a compact wireless sensor that is particularly applicable for wireless intrusion sensor systems that can be embedded within conventional window and door frames without piercing an outer wall of the frame.

The sensor unit has a housing that is no greater than 1 inch in length and is, in preferred form, less than ½ inch. The sensor components, including the sensor switch, microprocessor, wireless transmitter, timer, and power source all fit within a hollow interior of the sensor housing. To fit within the small-sized housing, the power source is a coin cell battery and is stacked with the microprocessor, switch, timer, and transmitter in such a way to fit within the sensor housing. An antenna extends from the wireless transmitter and externally of the housing to transmit a signal from the transmitter to an external source, such as an alarm system.

The microprocessor samples the switch state, as opposed to continuous monitoring, in order to conserve the battery power. Various electrical components and circuits allow the microprocessor to sample the switch state at select intervals, but allow the microprocessor to sleep or be nearly idle during non-sampling periods. During the idle periods, the power draw on the battery is negligible. Thus, the smaller size coin cell battery's life is extended several fold over the anticipated life of the battery during continuous monitoring.

BRIEF DESCRIPTION OF THE DRAWINGS

Like reference numerals are used to designate like parts throughout the several views of the drawings, wherein.

BEST MODE FOR CARRYING OUT THE INVENTION

Figure 1:
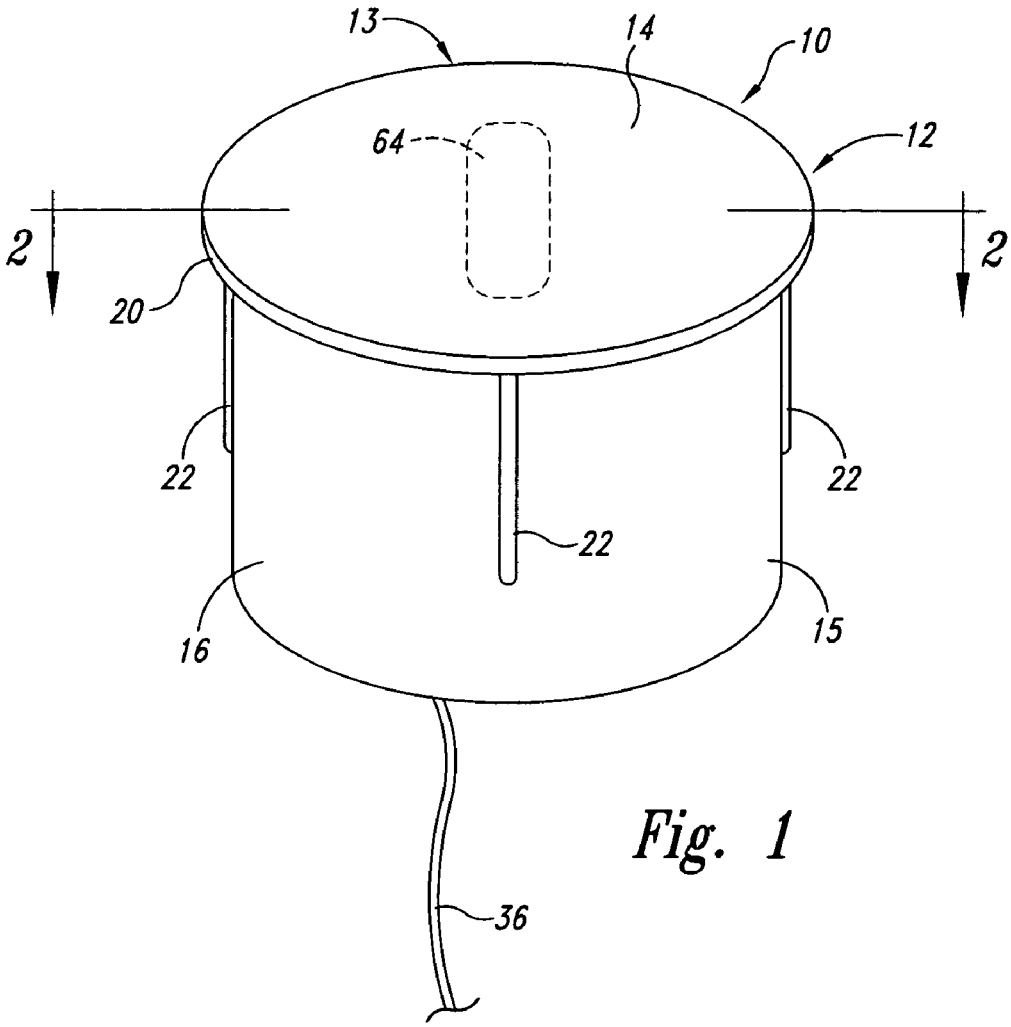
FIG. 1 is a perspective view of the assembled wireless security sensor of the present invention.

The present invention is directed to a compact wireless sensor, and, particularly, for use in wireless security systems, such as the system disclosed in the afore-mentioned '048 patent application and which is incorporated herein by reference. In addition to being of size that fits within a standard window frame having a width of approximately ½ to 1 inch between an exterior wall and an interior wall, the sensor may have a long life span by being able to conserve power consumption through sampling the state of the sensor, as opposed to continuous monitoring.

The preferred embodiment of the compact wireless sensor 10 of the present invention is illustrated in FIGS. 1–4. The sensor 10 includes a compact housing 12 having an upper face 14 and a side wall 16 that defines a hollow interior 18. In preferred form, the housing 12 is a two-piece cylindrical member having an upper cap 13 that is aligned with a cylindrical body 15 although, alternatively, a one-piece cylindrical body (such as illustrated by the housing in FIGS. 5 and 6) or other shapes (square for instance) may be used. Also in preferred form, the upper face 14 overhangs the side wall 16 by a small amount (approximately 0.050 inch) to form a small flange 20 that can act as an abutment when installed in its preferred application (discussed further below). In the preferred embodiment, the flange is an annular flange overhanging a cylindrical side wall. Optional thin ribs 22 may be added to the exterior of the sidewall running longitudinally of the sidewall to add enhanced friction fit when the housing of the sensor is installed into an opening of the window/door frame.

The overall length x of the side wall 16 is approximately ½ inch or less. This compact size over known prior art wireless sensors (roughly 1/10th or less of the afore-mentioned Ademco wireless sensor and roughly 1/8th or less of the afore-mentioned ITI wireless sensor) can be attained by the use of a different and smaller type power source, namely, a coin cell battery 24. In preferred form, the coin cell battery is a round 3V lithium ion CR1620 coin cell battery, which is a shelf good item.

Figure 2:
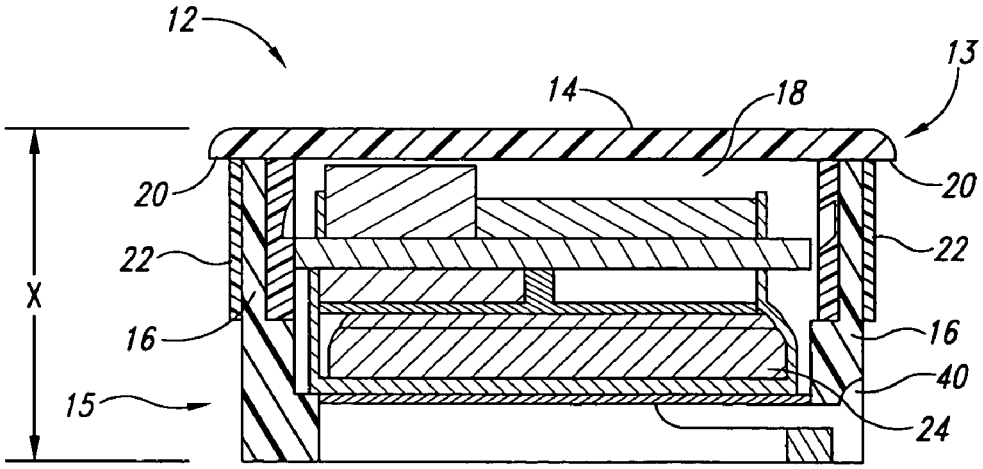
FIG. 2 is a section view of the assembled sensor taken substantially along lines 2—2 of FIG. 1, shown less the antenna.
Figure 3:
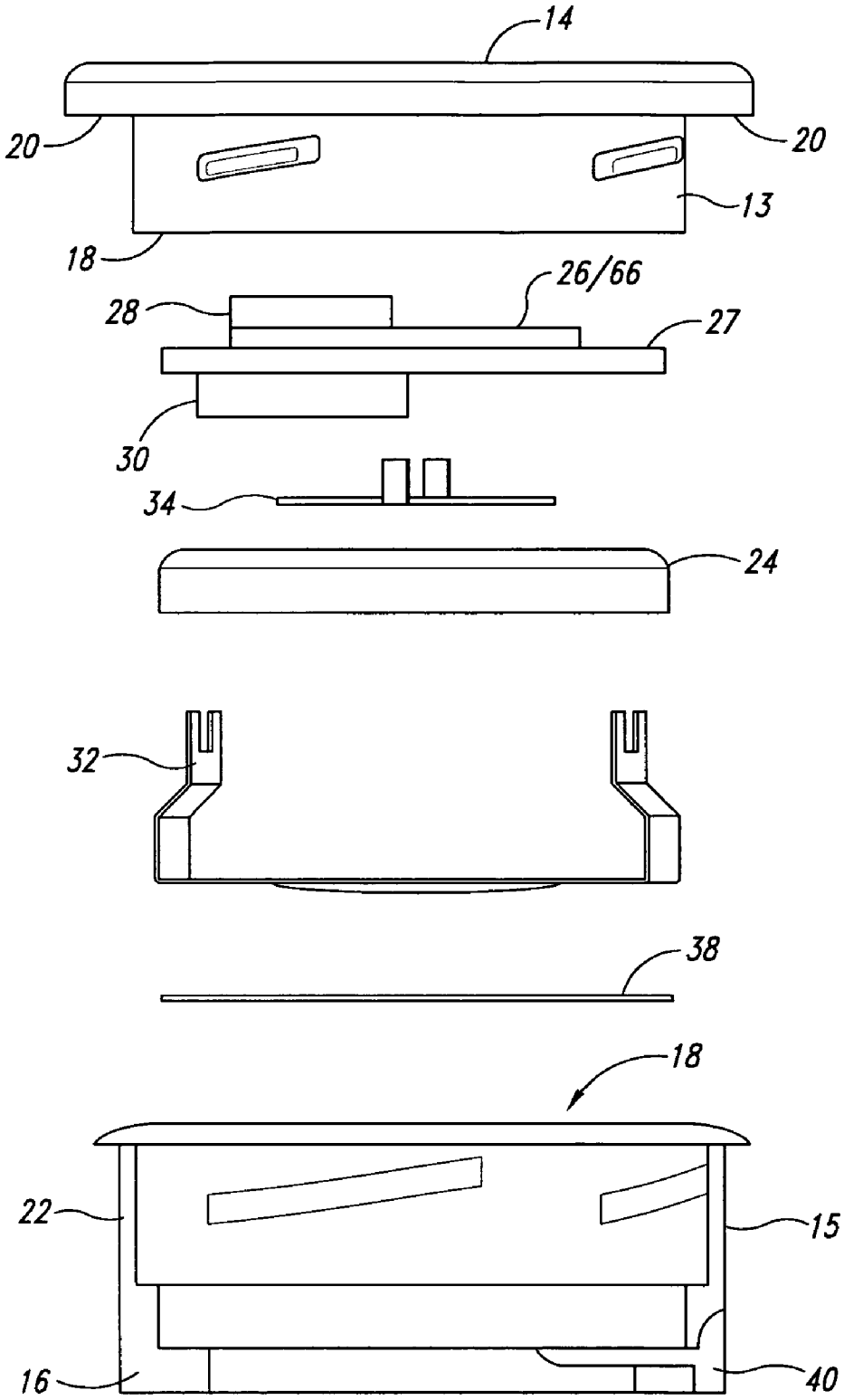
FIG. 3 is an exploded perspective view of the sensor of FIGS. 1 and 2 and better illustrating the preferred two-part housing.
Figure 4:
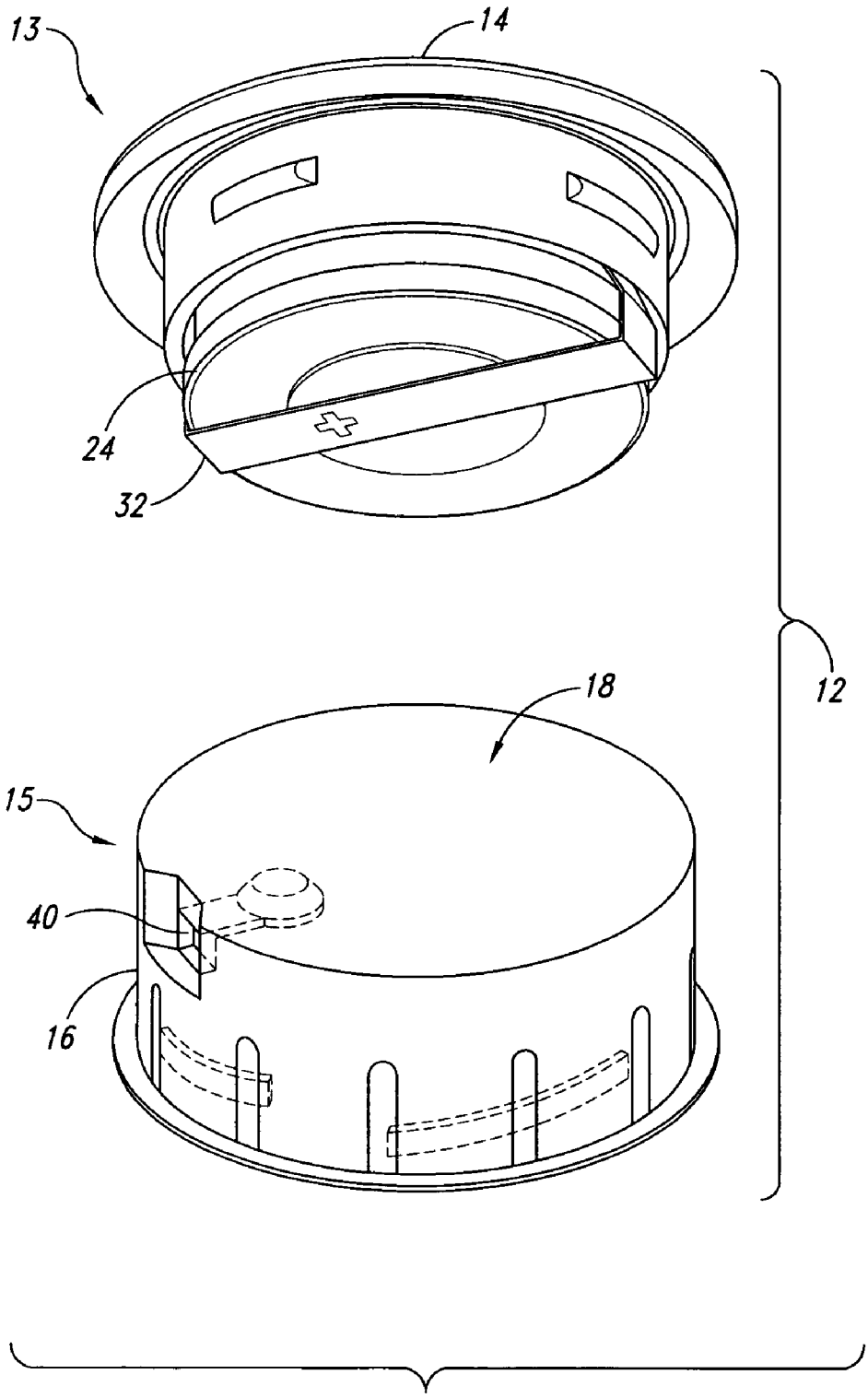
FIG. 4 is an exploded perspective view of the two-part housing with the cap illustrating housing of the components (PCB and microprocessor and wireless transmitter are all hidden) and the battery (shown) prior to assembly with the body of the housing.

Referring particularly to FIGS. 2 and 3, along with the round coin cell battery 24, the electrical components of the sensor include a microprocessor 26 and a low power clock circuit 66, a printed circuit board ("PCB") 27 onto which the microprocessor and low power clock circuit is mounted, a sensing switch 28 capable of sensing a change of state, and a wireless (e.g. RF) transmitter 30, which are all positioned within the housing interior 18. The positive terminal of the battery 24 is connected to the PCB 27, which is also preferably round in shape, by a first battery clip 32.

In preferred form, the sensing switch 28 is a reed switch, although other switching mechanisms can be used, such as physical contact switches or a magnetic sphere switches (e.g., as manufactured by Magnasphere Corp. of Brookfield, Wis.).

The negative terminal of the battery 24 is connected to the PCB 27, preferably by a second battery clip 34. The battery clips 32 and 34 may be soldered to the PCB. The battery 24 is thereby retained in an adjacent position relative to the wireless transmitter 30. The small power source (battery) in conjunction with the microprocessor, transmitter, and switch, all stacked together, allows the components to fit within the compact housing interior.

In preferred form, the positive battery clip 32 is a c-shaped clip in which it is attached to the PCB on two sides. In this manner, the battery stays in place even without the body attached (see FIG. 4). Further, the clip 32 has a very slight "spring clip" on the bottom of the clip, which provides the electrical contact to an antenna 36, which is discussed further below.

Antenna 36 (illustrated in FIG. 1 and also in FIG. 7) is used to transmit wireless signals from transmitter 30 to an external receiving panel or other receptor (not shown). The receiver panel is typically a function of a manufacturer's protocols, such as those provided by Ademco, ITI, Linear, and DSC. In the present invention, the microprocessor would be programmed to interface with the protocols of the chosen OEM manufacturer's receiver panel, of which choice and protocol programming would be within the realm of one of ordinary skill in the art.

The preferred antenna is a nearly ¼ wavelength dipole wire antenna. This is preferred over magnetic loop antenna or helical antenna, although both of these other type antennas will work with the present invention. The nearly ¼ wave wire antenna is preferred because it is a more efficient antenna than the smaller magnetic loop and helical antenna. As a more efficient antenna requires less transmit power to achieve a comparable range, it reduces the transmission pulse current requirements demanded on the smaller coin cell battery without sacrificing performance.

The sensor 10 also may include a snap-in closure or cap 38 for closing the bottom of the housing 12. In the preferred embodiment, wire antenna 36 extends from the housing 12 through a hole 40 (FIG. 2) in end plate 38. In preferred form, the hole is positioned on the side wall 16 at or near the bottom of body 15. Alternatively, the hole may be positioned within end plate 38.

The cap 13 is preferably made of a hard plastic, but the body 15 is preferably made out of a synthetic resilient material, such as Santaprene. When the cap is twisted onto the body to complete the housing, the Santaprene and hard plastic combination form a cam lock fit, analogous to an O-ring gasket. This combination provides better resistance to moisture. However, the housing still functions sufficiently for the purposes identified herein when manufactured of a solid plastic material or other hard man-made material.

Figure 5:
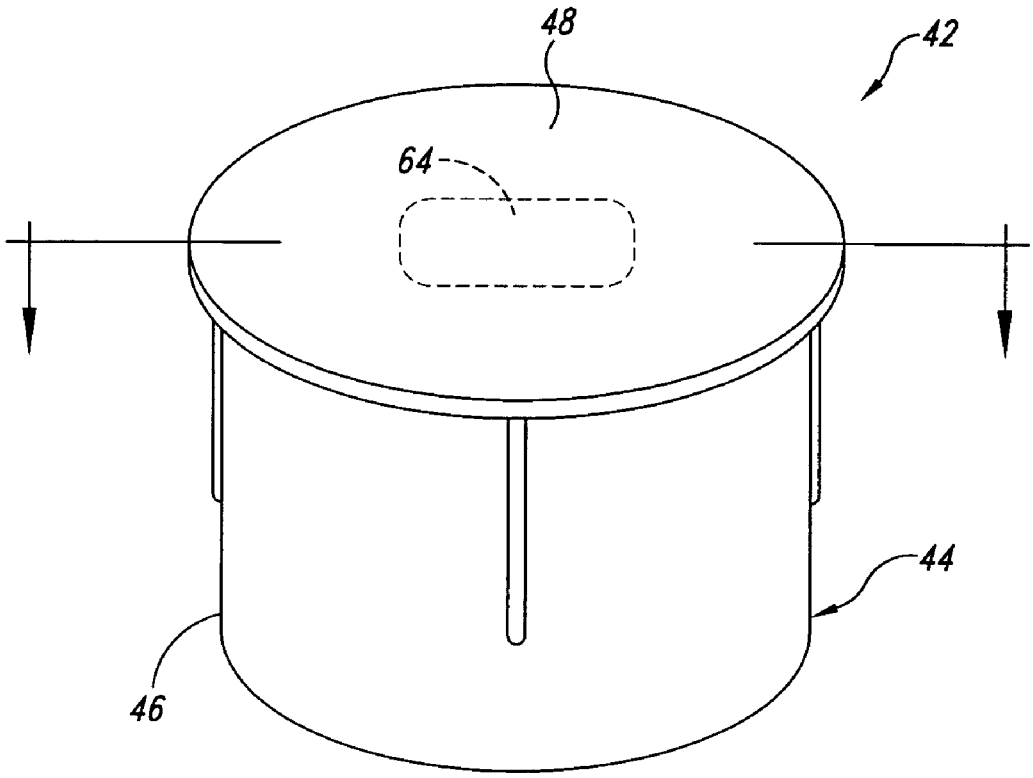
FIG. 5 is a perspective view of a magnet assembly of the present invention.
Figure 6:
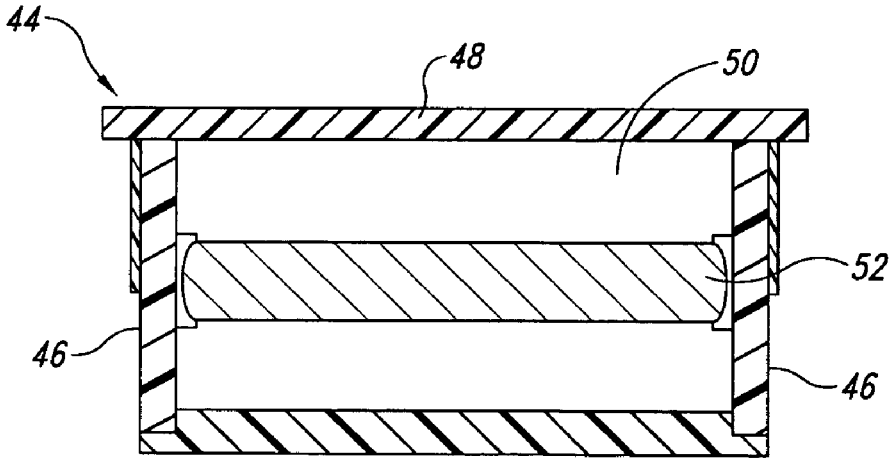
FIG. 6 is a section view of the magnet assembly taken substantially along lines 6—6 of FIG. 4.

Now referring to FIGS. 5 and 6, the magnetically activating circuit may be broken through a separate magnet assembly 42. A magnet housing 44 having a top face 46 and a side wall 48 define a hollow interior 50. The housing may be a solid cylindrical plastic member or a two-piece housing similar to the sensor housing identified at numeral "12". Utilizing the identical housing for both the sensor and magnetic assembly reduces costs and may improve aesthetics.

Inside the housing 44 is magnet 52, which is a shelf good item.

Figure 7:
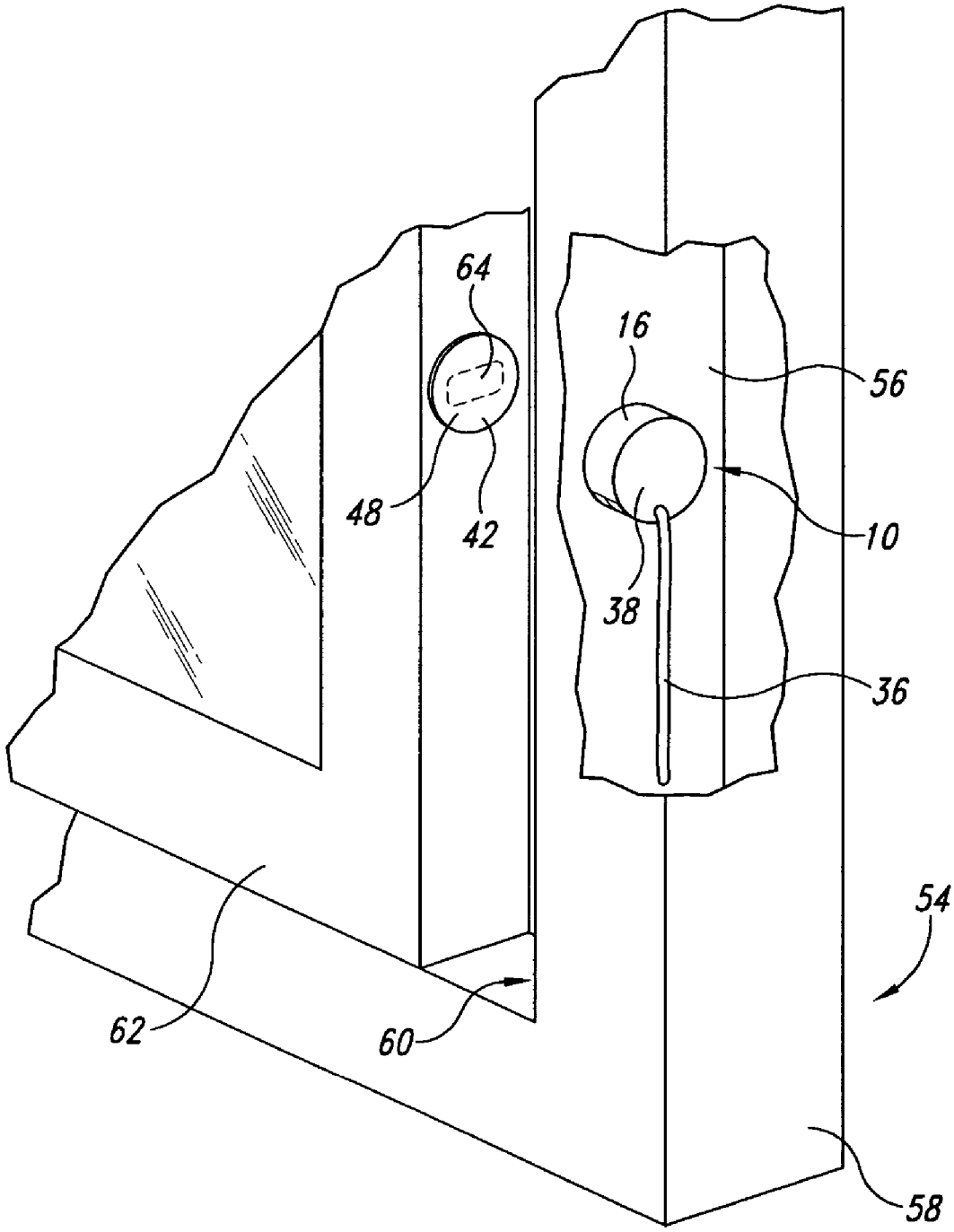
FIG. 7 is a perspective view of the sensor of FIG. 1 installed within a hollow portion of a frame, shown in cutaway, and the magnet assembly of FIG. 4 within a closure device.

The preferred application of the present invention is within a window or door frame 54, such as a vinyl extruded window or door, and complementary closure device 62 (e.g., window or door). Referring to FIG. 7, the sensor unit is installed within a hollow interior 56 of the frame 54 defined by an exterior wall 58 and an interior wall 60. Although window and door manufacturers vary greatly, the average thickness of the width of a vinyl extruded window frame is ½ to 1 inch.

Figure 8:
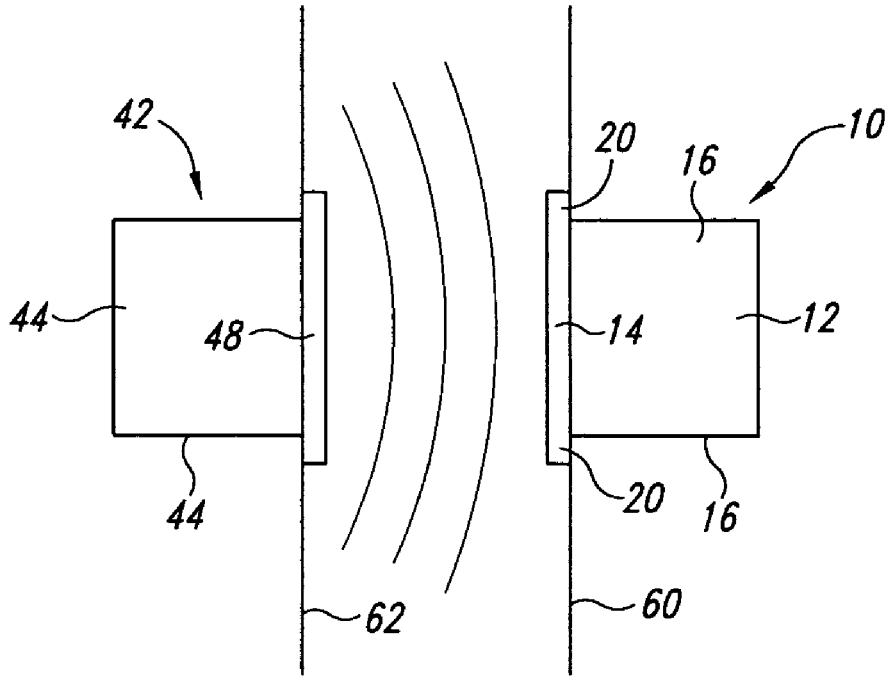
FIG. 8 is a schematic view showing a magnetic field between the magnet assembly and the sensor unit.

Referring also to FIG. 8, the face 14 of the sensor unit 10 is positioned nearly flush with the interior wall 60. The optional flange 20 acts as an abutment to better seat the sensor with an opening in a window frame or door frame, as do the ribs 22. The compact size of the sensor unit as described above is approximately less than ⅓ inch, which readily fits within the ½ to 1 inch standard window frame width without piercing the exterior wall 58. Similar to the invention discussed in the '048 patent application, the wire antenna 36 is preferably positioned within the hollow interior so that the sensor and antenna are virtually concealed from view.

Oppositely situated from the sensor face 14 is the face 48 of the magnet assembly housing, which is embedded within the closure 62. When the magnet assembly 42 is brought into close proximity with the sensor unit 10, the magnetic field activates the switch to change state. Similarly, when the closure device (e.g., window) is opened relative to the frame, the switch cannot receive the magnetic signal and the switch changes state.

Figure 9:
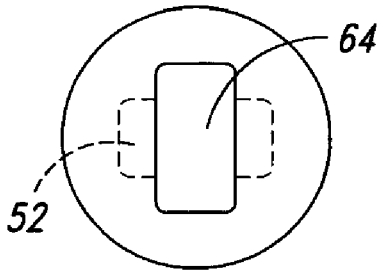
FIG. 9 is a front view of the magnet assembly illustrating indicia on the face of the magnet assembly.
Figure 10:
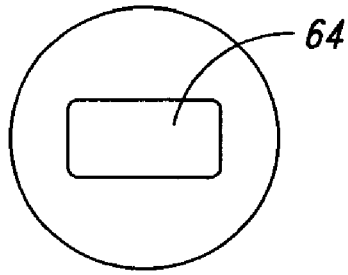
FIG. 10 is a front view of the sensor unit and illustrating indicia on the face of the sensor unit for polarity alignment with the face of the magnet assembly.

Referring also to FIGS. 9 and 10, indicia 64 may be added (e.g., molded as part of the housing, stamped, or otherwise affixed) to the faces of the sensor unit housing 12 and the magnet assembly housing. The indicia are used to assist with polar alignment of the magnet relative to the sensor switch. For example, the indicia 64 on the face of the magnet assembly 42 may be positioned perpendicularly above the magnet 52 to indicate a certain polarity of the magnet. If the switch is also placed below the indicia on the sensor unit to indicate position relative to the desired attraction of the magnet, the indicia of each housing (12, 44) are positioned relative to each other to establish the magnetic attraction. The indicia may be any shape or symbol that can indicate a desired polarity relative to the underlying magnet and its position relative to the sensor face indicia. For example, the indicia can be oblong shapes that are either aligned or cross-aligned depending on the positioning of the magnet relative to the oblong shape. In the example illustrated in FIGS. 9 and 10, the oblong-oriented indicia 64 are to be placed 90 degrees apart to indicate optimal magnetic attraction illustrated in FIG. 8 because the magnet is positioned 90 degrees relative to the oblong indicia.

Alternatively, any magnet that can be aligned so as to provide the magnetic field for closing the switch can be used.

Figure 11:
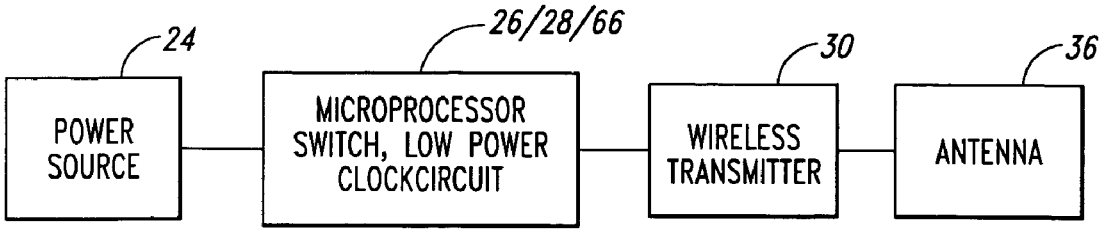
FIG. 11 is a block diagram of the electronic components of the sensor of FIG. 1 including the power source, switch, the lower power clock circuit, microprocessor, wireless transmitter, and antenna.

Although the above discussed sensor unit 10 will function nicely in the afore-mentioned '048 patent, as shown schematically in FIG. 11, the small size of the coin cell battery reduces the chemical reaction capacity and ergo the desired life term unless certain additions are made to reduce power consumption of the system. Thus, the present invention is also directed to a sensor that samples the switch state rather than continuously monitoring the state through the electronic components as discussed below.

To accomplish the sampling function, the microprocessor is programmed to have a standby mode in which the microprocessor reduces current consumption from the power source (the coin cell battery), a monitoring mode (the monitoring of the state of the switch), and a transmit mode where the state of the switch is transmitted via the wireless transmitter/antenna to an alarm or external device (e.g., a receiving panel).

Figure 12:
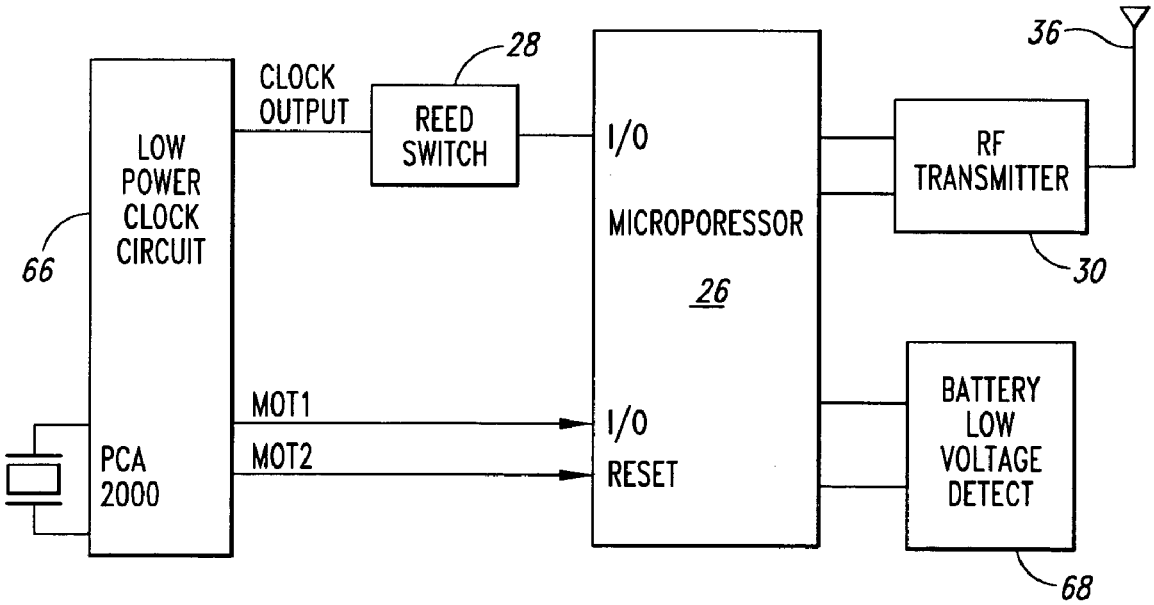
FIG. 12 is a schematic diagram of the sensor electronic components operating in the preferred embodiment of the standby mode.
Figure 13:
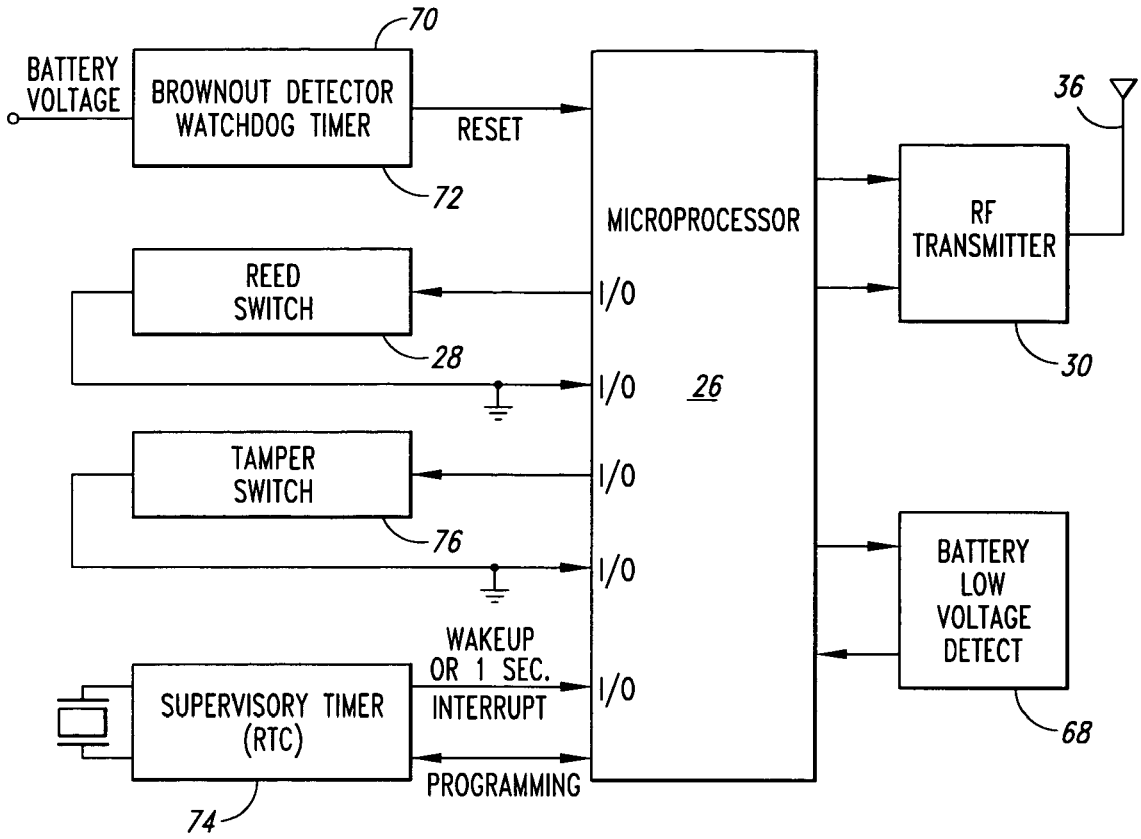
FIG. 13 is a schematic diagram of a first alternate embodiment of the sensor electronic components operating in a standby mode.

FIG. 12 is a block diagram illustrating the preferred form of the sensor with the microprocessor functioning in a standby mode. The microprocessor 26, which is preferably a Texas Instruments MSP430 FLASH programmable device that can utilize various protocols without hardware replacement, is connected to the sensor switch (reed switch) 28, a low power clock circuit 66, and a lower battery detection circuit 68. One alternative way to accomplish the standby mode is shown in FIG. 13, where a brownout detector 70 and watchdog timer 72 and supervisory timer 74 are added in lieu of the low power clock circuit 66. Alternatively, but schematically shown in FIG. 13, a tamper switch 76 may be added.

The brownout detector 70 in the alternate circuit is used to ensure that the microprocessor 26 does not "hang up" due to mechanical bounce when the battery 24 is inserted and the battery voltage to the microprocessor 26 is briefly interrupted. The brownout detector, which is a shelf good item, should use approximately 200 nanoamps of current.

Figure 14:
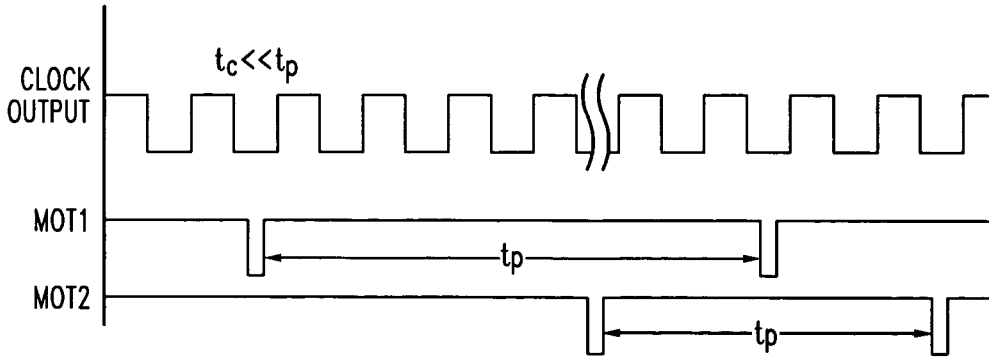
FIG. 14 is a schematic of the timing device of FIG. 12.

Referring to FIG. 14 and again to FIG. 12, the microprocessor is turned off most of the time to conserve power. Thus, the microprocessor needs to be woken up/turned on to evaluate the sensor switch state and increment a counter to ascertain when a signal needs to be sent to supervisory transmission. This is done with the low power clock circuit 66, which is preferably a watch circuit motor driver chip such as a PCA2002 from Philips. This chip operates at less than 100 nanoamps and may have three outputs: MOT1, MOT2, and a clock output, which in the preferred embodiment is a 32 Hz clock.

The first output is designated MOT1 and provides a brief high to low set of pulses, one per time period (once every 2 seconds in the preferred embodiment), in order to wake up the microprocessor and check whether a change of the sensor switch (e.g., reed switch) state has occurred. This time period is very small (e.g., on the order of 1 millisecond). The microprocessor is put back to sleep as soon as it has finished checking the status of the sensor switch and attended to the ministerial duties of timekeeping and clock adjustments.

The second output is designated as MOT2, which provides the same brief approximately 1 millisecond duration interrupt pulse. MOT2 replicates what is done with MOT1. The two MOT signals are separated by ½ time period, thereby resulting in a sample time equal to ½ the total period. In the preferred embodiment, this equates to checking the reed switch for a change of state once every second. MOT2 is further used to eliminate the brownout detector and supervisory timer of FIG. 12 by connecting to the chip's RESET line, as opposed to an I/O port. In this way, the microprocessor is fully reset every time period. If the microprocessor hangs up for any reason, it would then reset one time period later.

The last output is the clock output, which is used as the preferred way to sample the reed switch state. FIG. 12 shows the preferred implementation of the reed switch with the clock output. This embodiment uses the smallest and least expensive form A reed switch. Here, the third output from the clock output is sent through the reed switch, and is then filtered by a simple RC circuit and input to a counter port on the microprocessor 26. The RC filter acts to turn the square wave of the clock output into a series of narrow pulses that can be read by the counter. The preferred embodiment uses a 220 pF capacitor with a 1 Mohm resistor, which allows the microprocessor counter port to see a load when the reed switch is disconnected, yet only adds an incremental amount of draw (approximately 20 nanoamps). Without this load resistor present, the input would be floating. This condition could detect stray signals or noise that could impact the correct functioning of the counter.

The microprocessor does not have to be in its "on state" to allow its counter to operate. If the reed switch is closed, the counter will count to a maximum value of 32 (in the preferred embodiment) by the time the sample period occurs. If the reed switch opens in between sample times, the counter will not have reached the maximum value. Thus, an "open" will be identified and signaled accordingly. This method allows the current consumption to be kept low (due to only sampling once per second), yet still monitors a change to the reed switch (in the closed to open state) at a rate effectively equal to approximately 1/32nd of a second. The change from an open to closed state is not considered to be critical. For example, if the sensor is installed within a window, and the window was open, it would be assumed that the security system would not need to be armed. In such a case, the method samples a change of state only once per second.

The alternate circuit embodiment illustrated in FIG. 13 does not require the clock output. FIG. 13 schematically illustrates a form A reed switch connected across two I/O ports of the microprocessor. During each sample period, the two I/O ports are turned on and a test signal is sent through the reed switch. If the test signal is received at the other port (e.g., both output and input pulses are high at the sample time), then the switch is closed. Although this alternative uses a small and inexpensive reed switch, the switch detection of a change of state will be made only at the sample (test) time and will not be able to detect switch openings/closings during non-sample periods.

Figure 15:
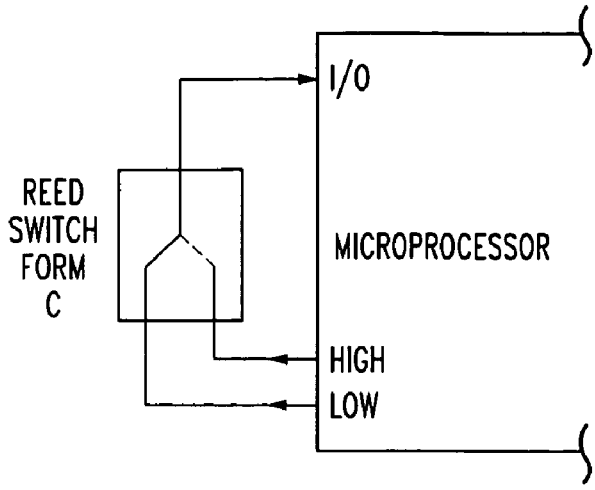
FIG. 15 is a schematic diagram of an alternate reed switch embodiment.

An alternate embodiment for sampling the reed switch circuit exists in FIG. 15. This figure illustrates a form C reed switch that is normally open in the presence of a magnet. In this case, a continuous voltage (high output) is ever present on the "closed" leg of the reed switch, and a continuous voltage (low output) is ever present on the "open" leg of the reed switch. Thus, when the reed switch closes (i.e., the magnet assembly moves away from the reed switch), the interruption (e.g., the window being opened) is immediately detected. Since the microprocessor is "woken up" by the change of either state at its I/O port, low power consumption is achieved without any additional sampling. Although the function of the form C reed switch is adequate for the purposes of the invention, the form C switch is more expensive and larger than that of the form A switch.

Figure 16:
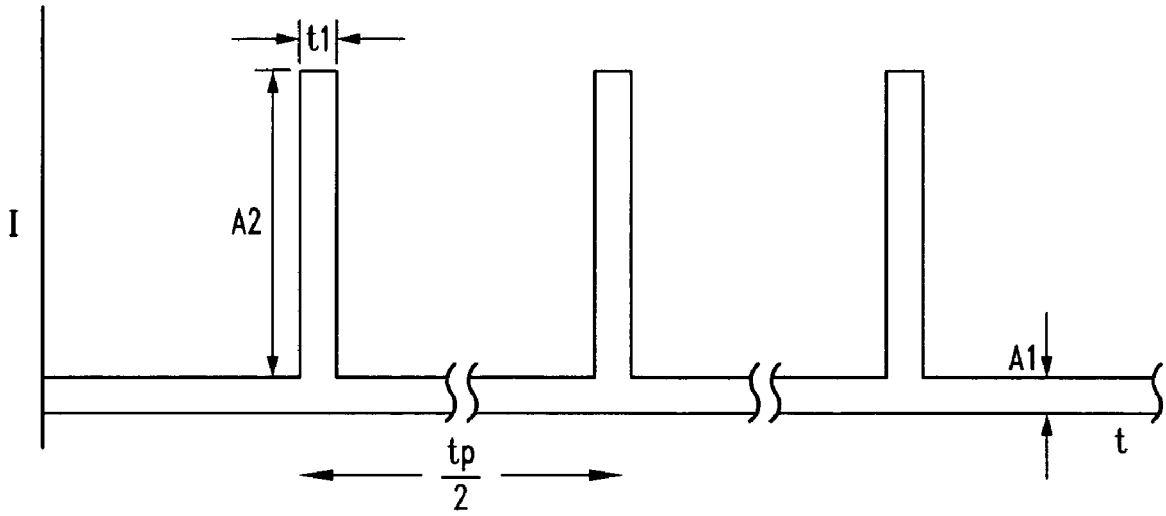
FIG. 16 is a graph illustrating the increase of the current draw of the electronic components of FIG. 12 during sampling.

As discussed above, the microprocessor samples the sensor switch state rather than continuously monitoring it. In doing this, the microprocessor is virtually turned off and run only during sample time, which provides the majority of the power savings over continuous monitoring. FIG. 16 illustrates the power savings between A2 current sampling at time t1 and when the A1 idle state over a sample time tp/2. Or in other words, the microprocessor 26 is normally in a standby mode, in which the microprocessor 26 can be put into a RAM retention mode in which there is a low standby current draw A1. In this standby mode, the sensor is in a substantially turned off state and draws only the very small current A1 from the battery 24. In the preferred embodiment, the total standby current of the entire sensor is typically on the order of less than 150 nanoamps. This standby mode conserves the battery's power and allows it to have a theoretical life in the range of 8–9 years.

Referring again to the alternate circuit of FIG. 13, the real-time chip (RTC) 78 is programmed to provide a 1-second periodic interrupt to the microprocessor 26, which then changes the microprocessor into a monitor mode and monitors the states of the reed switch 28, the tamper switch 76, and the battery low voltage detector circuit 68. During this monitor mode, the battery current draw is increased to A2 (FIG. 20) for a time $t_1$. If any change in the states of the reed switch 28, the tamper switch 76, and the battery low voltage detector circuit 68 is detected, the microprocessor 26 operates in its transmit mode and causes the RF transmitter 30 to broadcast an alarm signal. Otherwise, the microprocessor 26 returns to the standby mode.

The real-time chip 78 is used as an interrupt source rather than its main function as a real-time clock circuit. This is due to its specially optimized low power operation, which enables it to operate at a current consumption of less than 200 nanoamps. The tamper switch 76, which is optional, is connected between ports I/O(2) and I/O(3).

Thus, the real-time chip 78 can send an interrupt pulse to the microprocessor 26, the latter awakes from its RAM retention mode and starts operating using an internal clock. The microprocessor 26 checks the reed switch 28 by turning the I/O(1) port to an output HIGH, I/O(2) port to input, and the I/O(3) port to input. If there is a HIGH signal present at the I/O(2) port, then the reed switch 28 is closed, and otherwise it is open.

The microprocessor 26 then checks the tamper switch 76 by setting the I/O(1) port to input and the I/O(3) port to an output HIGH. If there is a HIGH signal present at the I/O(2) port, the tamper switch 76 is closed.

After the reed switch 28 and the tamper switch 76 have been checked, all three of the I/O(1), I/O(2) and I/O(3) ports are set to LOW, thus ensuring that during the standby mode no current draw occurs through the pull down resistor R1. All the circuitry in FIG. 13 combines to a typical current draw in practice of approximately 450 nanoaamps while in standby mode.

The RF transmitter 30 uses a Melexis single chip ASK transmitter in the preferred embodiment. This chip was chosen for its ability to vary the output power level into the antenna based on a single resistor on the PCB. It also allows transmission down to below 2.0 Volts.

Figure 17:
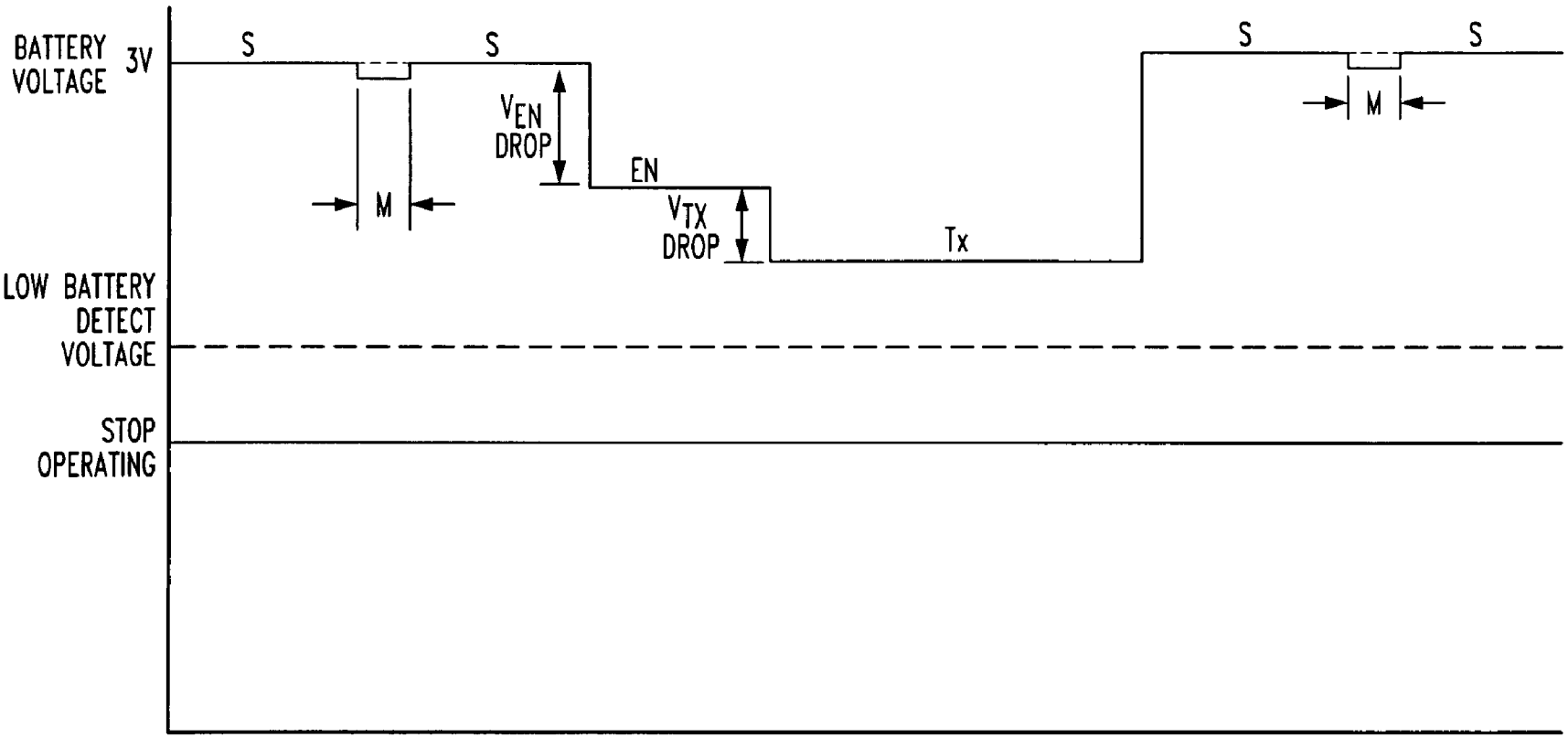
FIG. 17 is a graph illustrating variation of the battery voltage over time during different operational modes of the wireless security sensor.

A main reconsideration for maintaining long battery life is the ability of the wireless security sensor to operate at a reduced voltage. This reduced voltage occurs when there is a voltage supply drop due to the combination of the battery self-impedance and to the current draw required during transmit mode. The greater the current draw, the greater is the voltage supply drop. FIG. 17 shows a graph illustrating the variation of the battery voltage over time. The durations of the standby mode are indicated at S, the monitor mode at M, the transmit mode with the RF transmitter enabled and not transmitting at EN and with the RF transmitter enabled and transmitting at TX. As can be seen, there are progressively greater drops in the battery voltage during these modes, the largest, shown at TX, (being during transmission) but the voltage is then still maintained above the low battery detect voltage.

Figure 18:
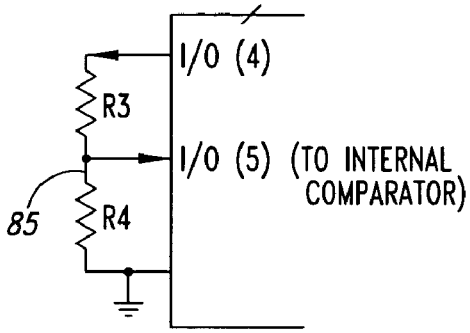
FIGS. 18 and 19 diagrammatically illustrate the circuits of two alternative battery low voltage detectors.

The low battery voltage detect circuit is shown in greater detail in FIG. 18 and is connected to an internal comparator/diode circuit in the microprocessor, which can be used for inexpensive monitoring of the battery voltage. This is achieved by means of a resistor divider indicated generally by reference numeral 85 in FIG. 18, which is formed by resistors R3 and R4. The voltage divider 85 is connected to ports I/O(5) of the microprocessor, which are turned on only when measurement of the battery voltage is effected at the start of a transmit pulse for maximum current draw. The ports are set to 0 volts to conserve power when the measurement has been completed.

Figure 19:
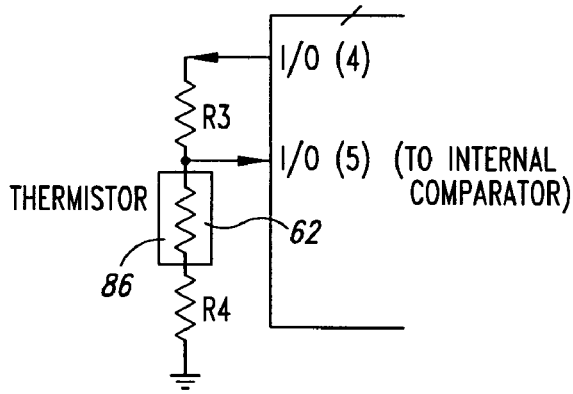
Figure 20:
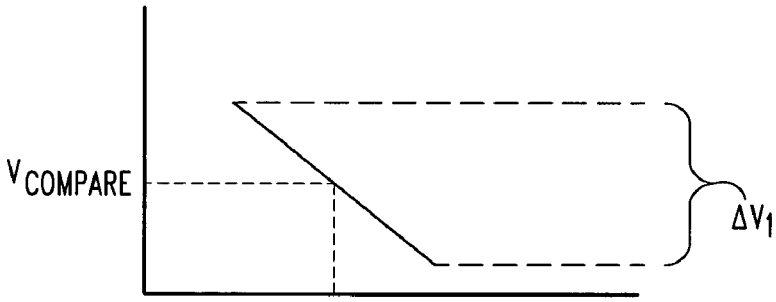
FIGS. 20 and 21 show voltage diagrams, corresponding to FIGS. 18 and 19, respectively.
Figure 21:
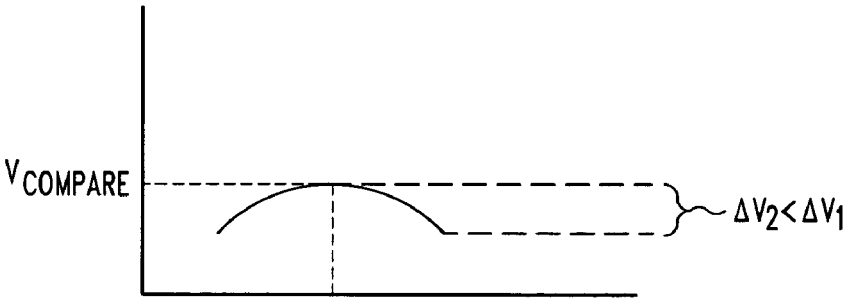

Since the MSP430 microprocessor used in the present embodiment is not very accurate over temperature variation, and may consequently cause a low battery threshold measurement to occur at low temperature, the circuit shown in FIG. 18 may be modified as illustrated in FIG. 19 by the addition of a thermistor 86 in series with the resistor R4. The addition of such a thermistor compensates for temperature variations relative to battery low voltage detection and is included in the preferred embodiment of the invention. Voltage diagrams of the circuits of FIGS. 18 and 19 are shown in FIG. 20 (which corresponds to FIG. 18) and FIG. 21 (which corresponds to FIG. 19). The detect voltage variation is reduced in the embodiment with the thermistor.

While the sensor described above is ideally applicable for intrusion security systems, the sensor may be used for other applications such as glass break sensing, temperature sensing, humidity sensing, and water intrusion sensing. Moreover, even installed in the intrusion security system for plastic window frame extrusions described above, it is to be understood that the present sensor invention not be restricted to such applications. Rather, the sensor according to the present invention may be employed in wooden windows and doors where the antenna can be run along a window frame or sash and hidden, for example, by weather-stripping, paint or other means.

The illustrated embodiments are only examples of the present invention and, therefore, are non-limitive. It is to be understood that many changes in the particular structure, materials, and features of the invention may be made without departing from the spirit and scope of the invention. Therefore, it is the Applicant's intention that its patent rights not be limited by the particular embodiments illustrated and described herein, but rather by the following claims interpreted according to accepted doctrines of claim interpretation, including the Doctrine of Equivalents and Reversal of Parts.

What is claimed is:

1. A compact wireless sensor assembly for detecting a change of state comprising:

a housing unit having an exterior top and side wall defining an interior space in which the side wall is no greater than 1 inch, said housing unit being of a size and shape that can be inserted within an existing conventional window or door frame without being generally visible from the front or rear;

a switch capable of detecting a given state and a change of state between the given state and at least one other state; a microprocessor being able to sample the state of the switch at select intervals and revert to an idle mode; a PCB, a wireless transmitter that can receive a signal from the microprocessor identifying a change of switch's state and transmit the signal from the microprocessor via a wireless antenna; a timer connected to said microprocessor for sampling the switch at the select time intervals; and a power source connected to the PCB for providing electric power to the microprocessor, the switch, the timer, and the wireless transmitter;

the antenna extending externally of the housing;

wherein said power source is a compact sized battery; and wherein said switch, said battery, said microprocessor, said wireless transmitter, and said timer are all positioned together to fit within said interior space of said housing unit.

2. The compact wireless sensor according to claim 1 wherein the power source is a round 3 volt lithium coin cell battery.

3. The compact wireless sensor according to claim 1 wherein the wireless transmitter is an RF transmitter.

4. The compact wireless sensor according to claim 1 wherein the antenna is a nearly ¼ wave wire antenna.

5. The compact wireless sensor according to claim 2 wherein the housing unit interior has a cylindrical shape and that the round coin cell battery is positioned concentrically within the cylindrical interior.

6. The compact wireless sensor according to claim 1 wherein the housing unit sidewall is no greater than ½ inch.

7. The sensor according to claim 1 wherein the switch is a magnetically activated reed switch.

8. The sensor according to claim 1 wherein the microprocessor operates in a standby mode further including a battery low voltage detect circuit and a low power clock circuit having two outputs, where one output goes to an I/O port on the microprocessor and the other resets the microprocessor.

9. The sensor according to claim 7 wherein the microprocessor operates in a standby mode further including a battery low voltage detect circuit and a low power clock circuit having two outputs, where one output goes to an I/O port on the microprocessor and the other resets the microprocessor.

10. The sensor according to claim 9 wherein the low power clock circuit further includes a third output that samples the reed switch at set intervals to detect a change of state.

11. The sensor according to claim 10 wherein the reed switch is a type Form A.

12. The sensor according to claim 10 wherein the reed switch is sampled by the microprocessor when the switch is known to be in the closed state.

13. The sensor according to claim 10 wherein the reed switch is a type Form C where any change of state of the reed switch interrupts the microprocessor.

14. The sensor according to claim 1 wherein the microprocessor operates in a standby mode further including a battery low voltage detect circuit and a real-time clock circuit, a tamper switch, and a brownout detector.

15. The sensor according to claim 1 wherein the real-time clock pulses at 1-second intervals.

16. The sensor according to claim 14 wherein the sensor switch is a magnetically activated reed switch.

17. The sensor according to claim 1 wherein the microprocessor operates in a standby mode further including a battery low voltage detect circuit, a supervisory timer, a watchdog timer and brown out detector that resets the microprocessor.

18. The sensor according to claim 17 wherein the sensor switch is a magnetically activated reed switch.

19. The sensor according to claim 7 further comprising a separate magnet assembly encased in a housing like that of the sensor and positioned relative to the sensor housing in order to change the state of the reed switch.

20. The sensor according to claim 1 wherein the microprocessor operates in a standby mode further comprising a battery low voltage detect circuit, a watch motor driver chip providing a one-second negative going pulse and resets the microprocessor, a tamper switch, and a brown detector.

21. The sensor according to claim 1 wherein the housing contains an upper cap having a side wall defining a cap opening and a body having a side wall that defines a body opening to which the side wall of the cap can be received into and abutted by the side wall of the housing in which the cap opening and the body opening form the hollow space of the housing.

22. The sensor according to claim 21 wherein the cap is made of a hard man-made material and the body is made of a resilient synthetic material.

23. The sensor according to claim 22 wherein the cap forms a cam lock fit with the base when the two parts of the housing are joined.

24. The sensor according to claim 23 wherein the battery is fixed to the PCB with a c-shaped clip that holds the battery to the cap.

25. The sensor according to claim 24 wherein the c-shaped clip contains a spring clip that connects to the antenna.

26. A wireless sensor assembly for detecting a change of state comprising:

a housing unit having an exterior top and side wall defining an interior space in which the side wall is no greater than 1 inch, said housing unit being of a size and shape that can be inserted within an existing conventional window or door frame without being generally without being generally visible from the front or rear;

a switch capable of detecting a given state and a change of state between the given state and at least one other state; a microprocessor being able to sample the state of the switch at select intervals and revert to an idle mode; a wireless transmitter that can receive a signal from the microprocessor identifying a change of switch's state and transmit the signal via an antenna; a timer connected to said microprocessor for monitoring the switch at the select time intervals; and a power source for providing electric power to the microprocessor, said timer, and said wireless transmitter;

wherein the power source is a 3 volt lithium coin cell compact sized battery.

27. A wireless sensor assembly for detecting a change of state comprising:

a housing unit having an exterior top and side wall defining an interior space in which the side wall is no greater than 1 inch, said housing unit being of a size and shape that can be inserted within an existing conventional window or door frame without being generally visible from the front or rear;

a switch capable of detecting a given state and a change of state between the given state and at least one other state; a microprocessor being able to sample the state of the switch at select intervals and revert to an idle mode; a wireless transmitter that can receive a signal from the microprocessor identifying a change of switch's state and transmit the signal via an antenna; a timer connected to said microprocessor for monitoring the switch at the select time intervals; and a power source for providing electric power to the microprocessor, said timer, and said wireless transmitter; and wherein said power source is a compact battery and wherein the wireless transmitter is an RF transmitter.

28. A wireless sensor assembly for detecting a change of state comprising:

a housing unit having an exterior top and side wall defining an interior space in which the side wall is no greater than 1 inch, said housing unit being of a size and shape that can be inserted within an existing conventional window or door frame without being generally visible from the front or rear;

a switch capable of detecting a given state and a change of state between the given state and at least one other state; a microprocessor being able to sample the state of the switch at select intervals and revert to an idle mode; a wireless transmitter that can receive a signal from the microprocessor identifying a change of switch's state and transmit the signal via an antenna; a timer connected to said microprocessor for monitoring the switch at the select time intervals; and a power source for providing electric power to the microprocessor, said timer, and said wireless transmitter; and wherein said power source is a compact battery and wherein the antenna is a nearly ¼ wave wire antenna.

29. A wireless sensor assembly for detecting a change of state comprising:

a switch capable of detecting a given state and a change of state between the given state and at least one other state; a microprocessor being able to sample the state of the switch at select intervals and revert to an idle mode;

a wireless transmitter that can receive a signal from the microprocessor identifying a change of switch's state and transmit the signal via an antenna; a timer connected to said microprocessor for monitoring the switch at the select time intervals; and a power source for providing electric power to the microprocessor, said timer, and said wireless transmitter; and wherein said power source is a compact battery and wherein the microprocessor operates in a standby mode further including a battery low voltage detect circuit and a low power clock circuit having two outputs, where one output goes to an I/O port on the microprocessor and the other resets the microprocessor.

30. A wireless sensor assembly for detecting a change of state comprising:

a switch capable of detecting a given state and a change of state between the given state and at least one other state; a microprocessor being able to sample the state of the switch at select intervals and revert to an idle mode; a wireless transmitter that can receive a signal from the microprocessor identifying a change of switch's state and transmit the signal via an antenna; a timer connected to said microprocessor for monitoring the switch at the select time intervals; and a power source for providing electric power to the microprocessor, said timer, and said wireless transmitter; and wherein said power source is a compact battery and wherein the switch is a magnetically activated reed switch, and further wherein the microprocessor operates in a standby mode further including a battery low voltage detect circuit and a low power clock circuit having two outputs, where one output goes to an I/O port on the microprocessor and the other resets the microprocessor.

31. The sensor assembly according to claim 30 wherein the low power clock circuit further includes a third output that samples the reed switch at set intervals to detect a change of state.

32. A wireless sensor assembly for detecting a change of state comprising:

a switch capable of detecting a given state and a change of state between the given state and at least one other state; a microprocessor being able to sample the state of the switch at select intervals and revert to an idle mode; a wireless transmitter that can receive a signal from the microprocessor identifying a change of switch's state and transmit the signal via an antenna; a timer connected to said microprocessor for monitoring the switch at the select time intervals; and a power source for providing electric power to the microprocessor, said timer, and said wireless transmitter; and wherein said power source is a compact battery and wherein the microprocessor operates in a standby mode further including a battery low voltage detect circuit and a real-time clock circuit, a tamper switch, and a brownout detector.

33. The sensor assembly according to claim 32 wherein the real-time clock pulses at 1-second intervals.

34. The sensor assembly according to claim 32 wherein the sensor switch is a magnetically activated reed switch.

35. A wireless sensor assembly for detecting a change of state comprising:

a switch capable of detecting a given state and a change of state between the given state and at least one other state; a microprocessor being able to sample the state of the switch at select intervals and revert to an idle mode; a wireless transmitter that can receive a signal from the microprocessor identifying a change of switch's state and transmit the signal via an antenna; a timer connected to said microprocessor for monitoring the switch at the select time intervals; and a power source for providing electric power to the microprocessor, said timer, and said wireless transmitter; and wherein said power source is a compact battery and wherein the microprocessor operates in a standby mode further including a battery low voltage detect circuit, a supervisory timer, a watchdog timer and brown out detector that resets the microprocessor.

36. The sensor assembly according to claim 35 wherein the sensor switch is a magnetically activated reed switch.

37. A wireless security sensor system, comprising:

a pair of members;

the members comprising a frame having a first exterior surface and second interior surface with a hollow interior therebetween defining an opening and a closure having a peripheral exterior surface movable relative to the frame between open and closed positions, the closure closing the opening in the closed position;

a sensor unit embedded in the hollow interior of the frame;

the sensor unit including a housing and the housing having a sidewall and an outer end that defines a hollow interior of the sensor unit, and said sensor unit being of a size to fit within the hollow interior of the frame between the first exterior surface and second exterior surface;

the sensor unit further including a magnetically activated sensor switch, a microprocessor, a wireless transmitter, a timer, and a coin cell battery that all fit within the sensor unit housing hollow interior; and a magnet assembly having a first end and a second end mounted in the closure for actuating the sensor switch.

38. The wireless security sensor system according to claim 37 wherein the outer end of the sensor housing embedded in the frame and the second end of the magnet assembly embedded in the closure are facing each other when the closure closes the opening.

39. The wireless security sensor system according to claim 37 wherein the microprocessor operates in a standby mode further including a battery low voltage detect circuit and a low power clock circuit having two outputs, where one output goes to an I/O port on the microprocessor and the other resets the microprocessor.

* * * * *

UNITED STATES PATENT AND TRADEMARK OFFICE

CERTIFICATE OF CORRECTION

PATENT NO. : 7,081,816 B2
APPLICATION NO. : 10/837087
DATED : July 25, 2006
INVENTOR(S) : Schebel et al.

It is certified that error appears in the above-identified patent and that said Letters Patent is hereby corrected as shown below:

Col. 12, line 6: Please delete "without being generally"

Signed and Sealed this

Seventeenth Day of October, 2006

JON W. DUDAS
*Director of the United States Patent and Trademark Office*